US006931801B2

(12) United States Patent
Hedrick

(10) Patent No.: US 6,931,801 B2
(45) Date of Patent: Aug. 23, 2005

(54) LIVE RECOVERY STORAGE STRUCTURE

(75) Inventor: Thomas W. Hedrick, 102 Larkspur, Sikeston, MO (US) 63801

(73) Assignees: Thomas W. Hedrick, Sikeston, MO (US); Phillip Barry South, Idaho, ID (US)

( * ) Notice: Subject to any disclaimer, the term of this patent is extended or adjusted under 35 U.S.C. 154(b) by 0 days.

(21) Appl. No.: 10/375,802

(22) Filed: Feb. 27, 2003

(65) Prior Publication Data

US 2004/0168378 A1 Sep. 2, 2004

(51) Int. Cl.[7] ..... E04H 7/00
(52) U.S. Cl. ..... 52/197; 52/192
(58) Field of Search ..... 52/169.5, 192, 52/195, 197 OR, 169; 222/564, 181.1, 462, 181.3, 460, 544

(56) References Cited

U.S. PATENT DOCUMENTS 1,576,940 A * 3/1926 Warner ..... 52/194
3,319,807 A * 5/1967 Raden ..... 414/269
4,563,844 A * 1/1986 Driedger ..... 52/192
4,603,795 A * 8/1986 Bonerb et al. ..... 222/262
4,841,693 A * 6/1989 Welsh ..... 52/197
4,881,665 A * 11/1989 McGuire ..... 222/181.3

* cited by examiner

*Primary Examiner*—Laurie K. Cranmer
(74) *Attorney, Agent, or Firm*—Workman Nydegger

(57) ABSTRACT

A live recovery storage structure for holding bulk material includes a housing having a side boundary wall with an inverted substantially U-shaped or V-shaped transverse cross section that extends between a first end wall and an opposing second end wall. The housing bounds a chamber adapted to receive bulk such that the bulk material rests against the side boundary wall. An elongated tunnel wall extends within or below the housing, the tunnel wall bounding a tunnel. At least one opening is formed on the housing so as to provide fluid communication with the chamber. A dispenser assembly is mounted on the tunnel wall so as to proved controlled fluid communication between the chamber and the tunnel.

42 Claims, 12 Drawing Sheets

LIVE RECOVERY STORAGE STRUCTURE

CROSS-REFERENCE TO RELATED APPLICATIONS

Not applicable.

BACKGROUND OF THE INVENTION

1. The Field of the Invention

The present invention relates to live recovery storage structures for holding bulk material and methods of manufacture thereof.

2. The Relevant Technology

The large storage of bulk materials, such as grains and powders, has included some systems that provide substantially all of the material in a live recovery scheme. "Live recovery" means that at least a substantial portion of the bulk material can freely flow from the storage system under the force of gravity. The benefit of this system is that the bulk material can be rapidly dispensed from the system such as for filling ships or other transport vehicles. Live recovery systems are in contrast to reclaimer type systems where a substantial portion of the bulk material must be mechanically removed from the system. In reclaim type systems, the rate of dispensing is limited by the capacity of the reclaimer.

Depicted in FIG. 1 is one embodiment of a conventional live recovery storage system for bulk materials. The system includes a structure 10 bounding a holding chamber 12. Structure 10 includes opposing side walls 14 and 16 that outwardly slope in opposing directions so as to form a substantially V-shaped funnel. The funnel feeds to a hopper 18 that communicates with a tunnel 20. In view of the sloping configuration of side walls 14, 16, all of the bulk material stored within holding chamber 12 of structure 10 freely flows to hopper 18 for dispensing into or onto a transport vehicle within tunnel 20.

Although conventional live recovery storage systems are effective, they have a number of drawbacks. For example, because side walls 14 and 16 are outwardly sloping and support the weight of the bulk material, they must have a substantial amount of lateral support. As such, structure 10 is constructed with a large outwardly sloping earthen bank 22 being formed against each side wall 14 and 16. Earthen banks 22 support the side walls 14, 16 in their desired orientation and enable the side walls to withstand the applied loads of the bulk material. Earthen banks 22, however, can be expensive to erect and can occupy a significant amount of valuable space.

BRIEF DESCRIPTION OF THE DRAWINGS

Various embodiments of the present invention will now be discussed with reference to the appended drawings. It is appreciated that these drawings depict only typical embodiments of the invention and are therefore not to be considered limiting of FIG. 1 is a cross sectional side view of a prior art live recovery storage system.

DETAILED DESCRIPTION OF THE PREFERRED EMBODIMENTS

Figure 1:
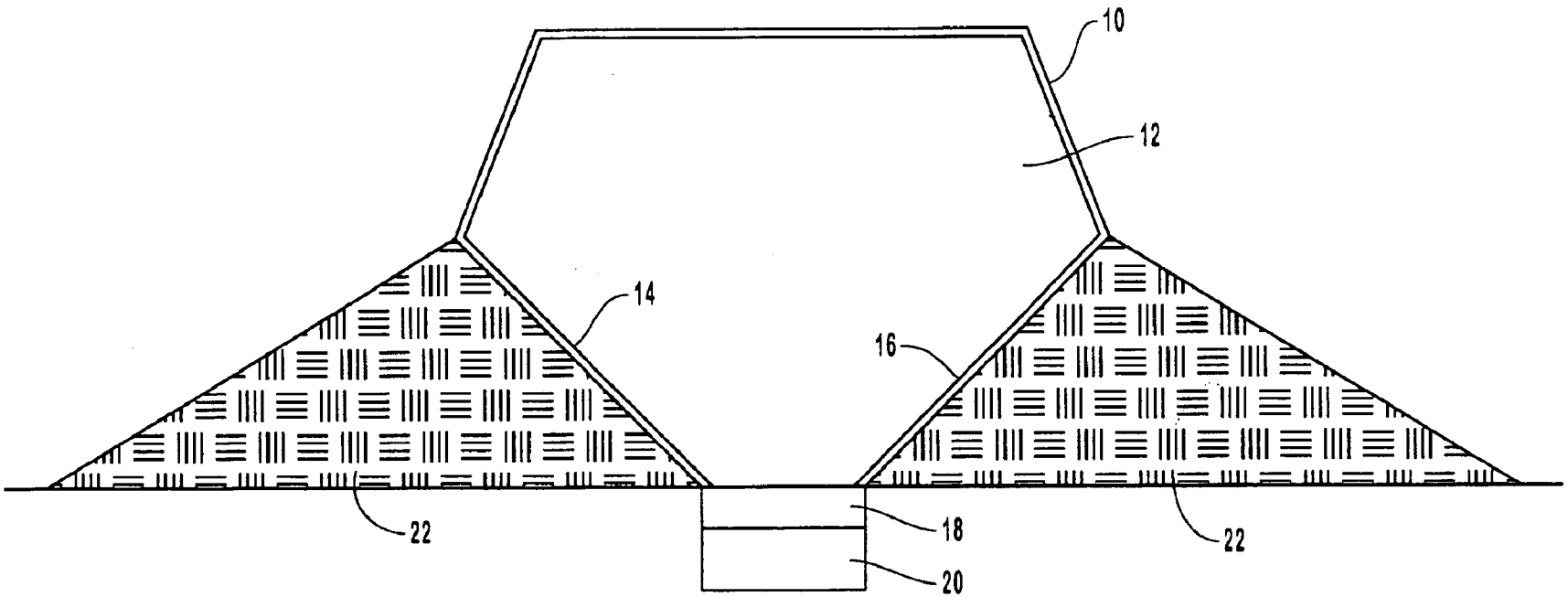
FIG. 1 (PRIOR ART)
Figure 2:
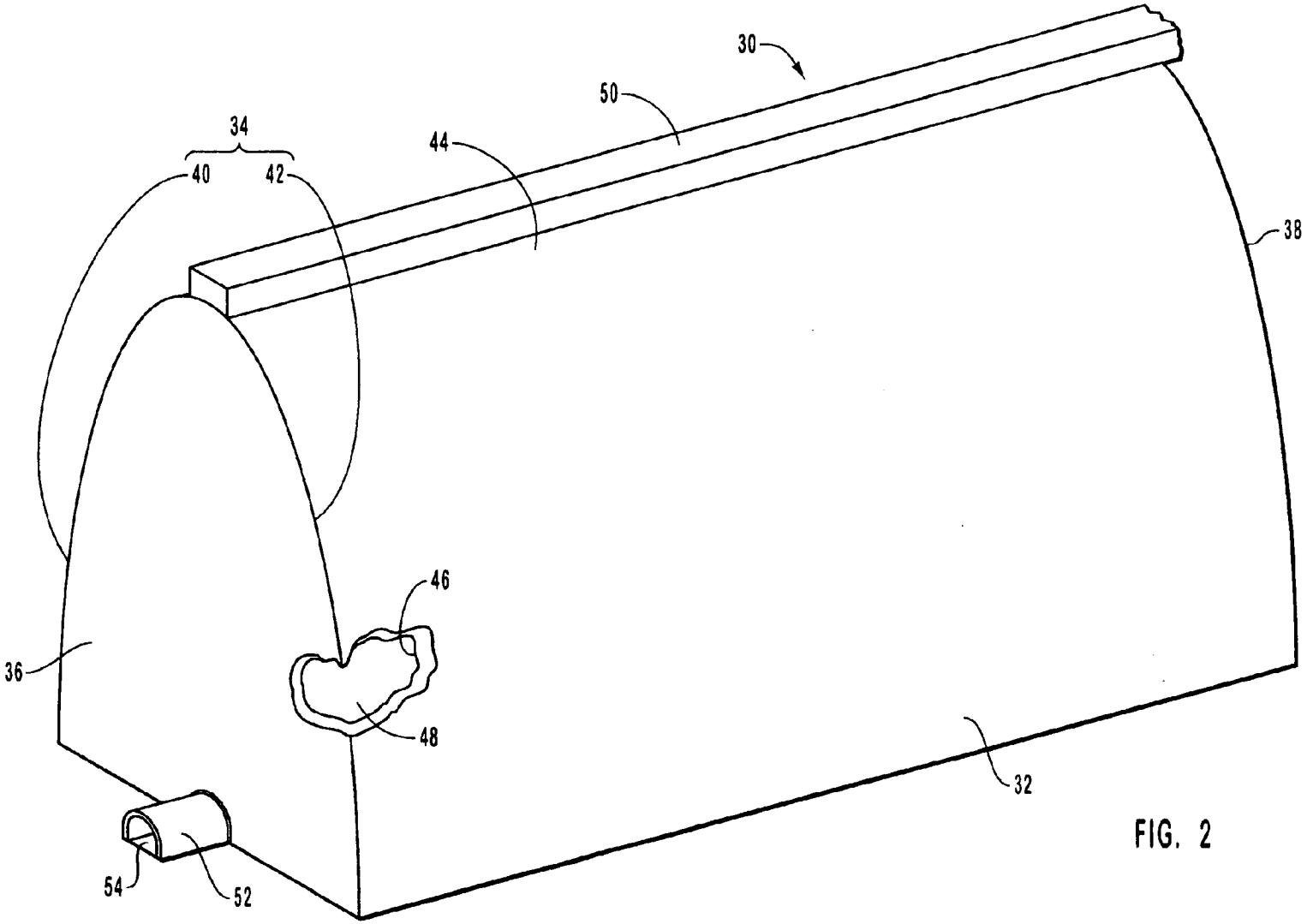
FIG. 2 is a perspective view of one inventive embodiment of a live recovery storage system.

Depicted in FIG. 2 is one embodiment of a live recovery storage system 30 incorporating features of the present invention. As discussed below, storage system 30 is designed for the storage and dispensing of bulk materials. The term "bulk material(s)" as used in the specification and appended claims is intended to include grains, legumes, salt, cement, and other granulated and powdered flowable food and non-food materials.

Storage system 30 comprises an outer housing 32 having a side boundary wall 34 extending between a first end wall 36 and an opposing second end wall 38. Boundary wall 34 is shown having a substantially U-shaped transverse cross section and includes a first sidewall 40 and an opposing second sidewall 42 that intersect along a central section 44. Outer housing 32 has an interior surface 46 that at least partially bounds a storage compartment 48. Storage compartment 48 is configured to receive and retain bulk material.

Mounted on and extending along central section 44 of side boundary wall 34 is a conveyor housing 50. As will be discussed below in greater detail, conveyor housing houses a conveyor that brings the bulk material to housing 32 and deposits it within storage compartment 48.

A tunnel wall 52 extends at least partially through outer housing 32 in alignment between first end wall 36 and second end wall 38. Tunnel wall 52 bounds a tunnel 54. As will be discussed below in greater detail, the bulk material is selectively fed through tunnel wall 52 and into tunnel 54 where it is removed through some form of transport vehicle.

Figure 3:
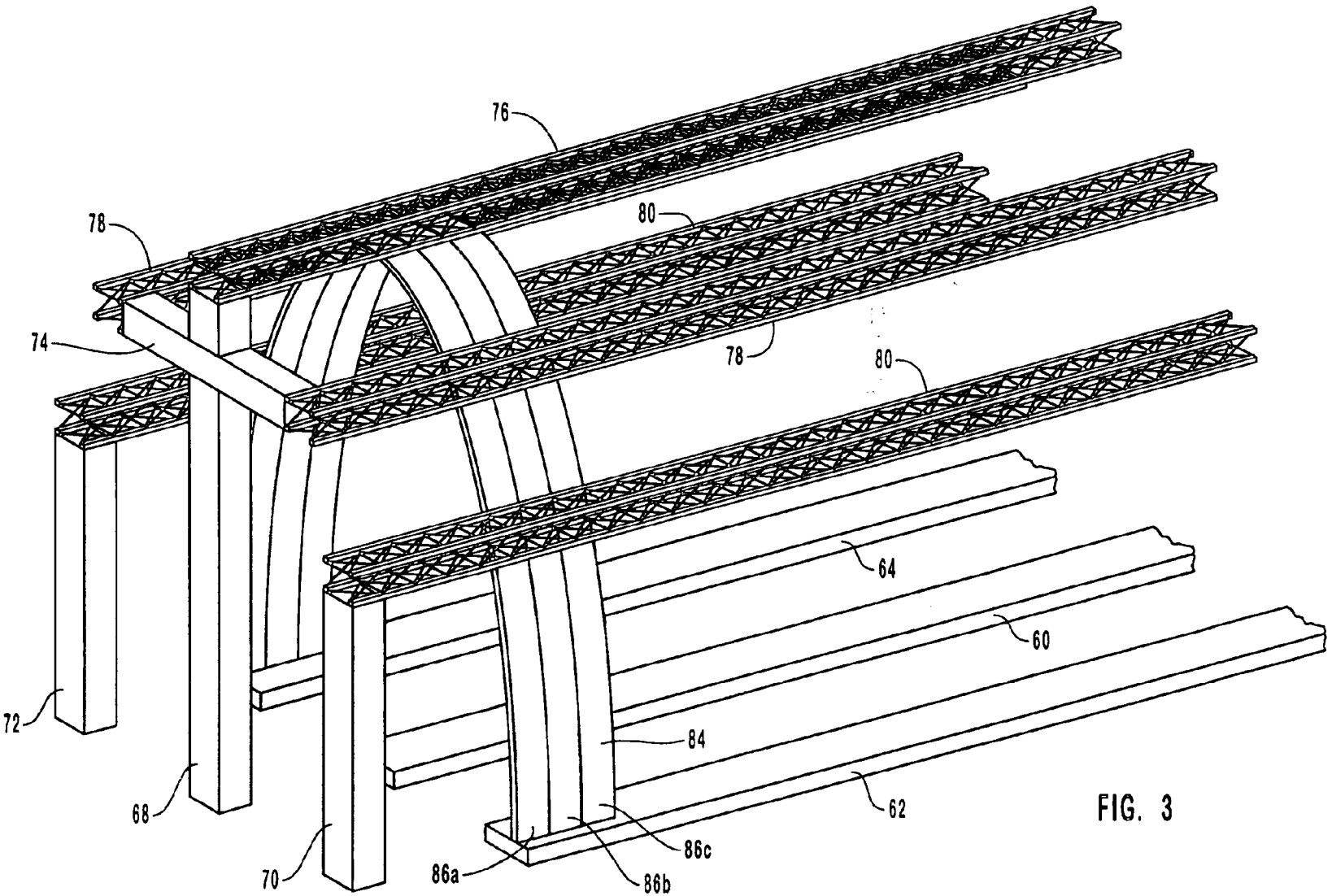
FIG. 3 is a perspective view of erected trusses supporting a form used in making the storage system of FIG. 2.

Further features and functions of live recovery storage system 30 will now be described with reference to the manufacture of system 30. With reference to FIG. 3, foundations are initially formed to support outer housing 32 and tunnel wall 52. Specifically, an elongated tunnel foundation 60 is formed that functions as both a floor for tunnel 54 and a foundation for tunnel wall 52. Elongated side foundations 62 and 64 extend along the intended sides of outer housing 32 and are used a foundation for side walls 40 and 42. Similar foundations are also formed to support end walls 36 and 38.

The foundations are typically comprised of poured concrete having reinforcing embedded therein. The foundations can have any desired transverse cross section that satisfies the building parameters. For example, foundations should be dimensioned to withstand frost conditions and be designed in accordance with the size of the corresponding structure and the weight bearing capacity of the underlying soil.

In addition to laying the various foundations, supports are erected to support portions of outer housing 32 during the assembly thereof. In the embodiment depicted, a head column 68 is centrally mounted at each end of intended outer housing 32. A cross bar 74 outwardly extends from the top end of each head column 68. Mounted on each side of each head column 68 are shorter knee columns 70 and 72. Extending between the upper end of the opposing head columns 68 is a head truss 76. Extending between opposing cross bars 74 at opposing ends thereof are shoulder trusses 78. Finally, a knee truss 80 extends between each opposing knee column 70 and each opposing knee column 72. It is appreciated that the columns and trusses can come in a variety of different configurations and can be placed in a variety of different placement to perform their intended supporting function. For example, overhanging columns can be placed along the sides of the trusses as opposed to the ends thereof to support the trusses.

Once the various trusses are erected, a form 84 is secured to the trusses extending in an arch between side foundations 62 and 64 and extending along the intended length of side boundary wall 34. Specifically, in one embodiment, form 84 is produced by fabricating a plurality of substantially U-shaped panel sections 86*a–z*. Each panel section 86 typically has a relatively narrow width in a range between about 0.25 meters to about 1 meter. Once formed, panel section 86*a* is erected with opposing ends being secured to side foundations 62 and 64. Panel section 86*a* is also temporarily secured to each of trusses 76, 78, and 80 so as to secure and stabilize panel section 86*a* in the upstanding position. In alternative embodiments it is appreciated that not all of trusses 76, 78, and 80 are required to secure panel sections 86. That is, one or more of trusses 76, 78, and 80 with corresponding columns can be eliminated.

Once the first panel section 86*a* is secured in place, a second panel section 86*b* is erected and secured adjacent thereto. The adjacent panel sections are then secured together such as by cold form crimping, welding, bolting, clips, interlocking flanges, or the like. The process is continued until form 84 is completed extending along the intended length of side boundary wall 34.

Panel sections 86 can be made from a variety of different materials such as metal, plastic, composites, cement, or the like. Panel sections 86 can also be prefabricated or fabricated on-sight. In one embodiment, panel sections 86 are fabricated on-sight to specified dimensions out of coiled sheet metal typically having a thickness in a range between about 0.2 mm to about 4 mm. In this embodiment, panel sections 86 are typically fabricated by use of a conventional roll forming machine.

Figure 4:
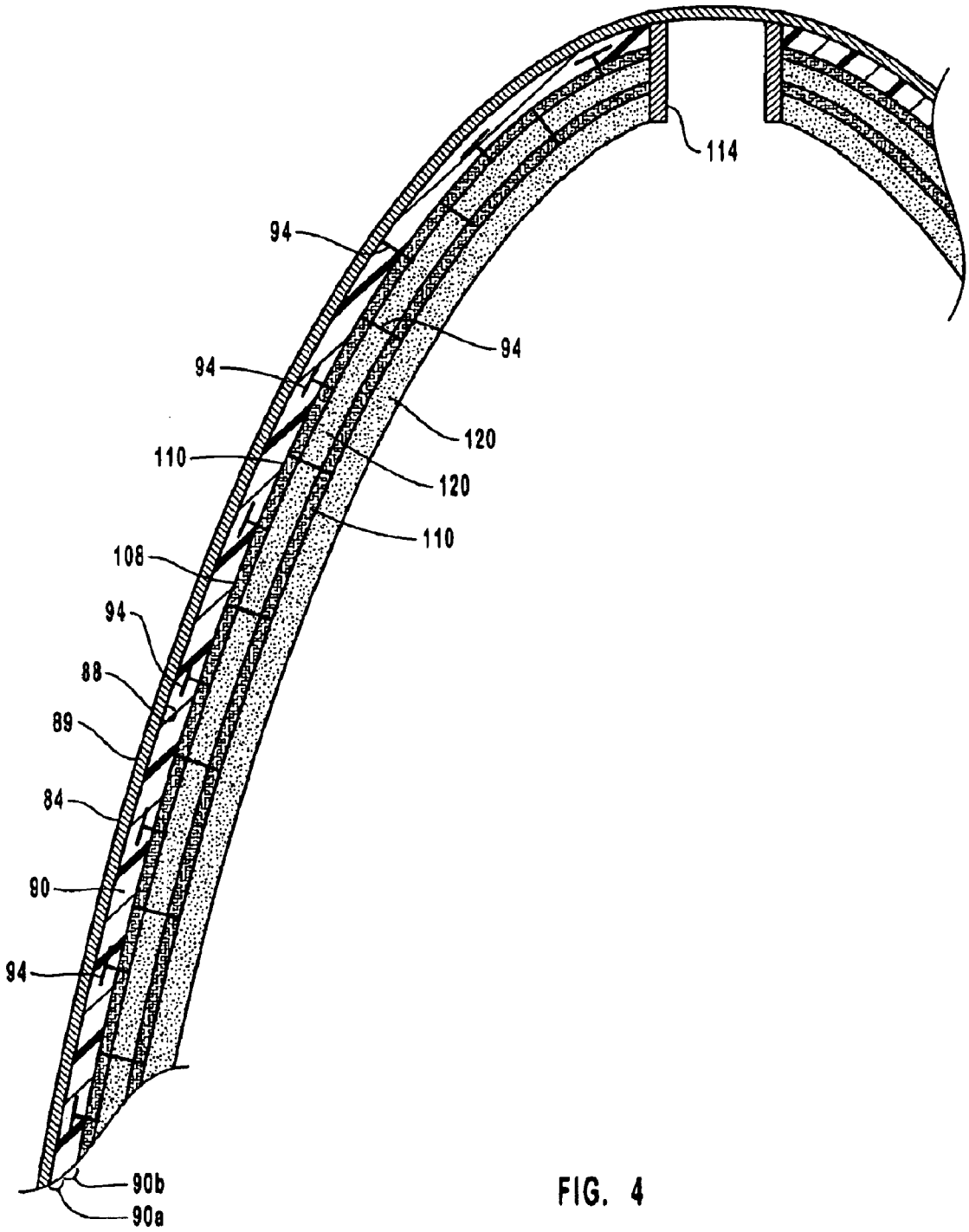
FIG. 4 is a cross sectional side view of a portion of the side wall of the outer housing shown in FIG. 2.

Turning to FIG. 4, form 84 has an interior surface 88 and an opposing exterior surface 89. Once form 84 is completed, a base layer 90 is applied to interior surface 88 of form 84. Base layer 90 is generally comprised of a polymeric foam. As used in the specification and appended claims, the term "polymeric foam" is intended to include all polymeric materials that have been expanded in some way so as to form a foam. Examples of polymeric foams include polyurethane foam, Styrofoam, and other conventional expandable polymeric foams. The polymeric foam can also comprise additives such as fillers, fibers, or other additives which affect properties such as strength, expansion, setting, finish, and the like. The polymeric foam can be applied through conventional spraying techniques or other conventional processes. Likewise, the polymeric foam can be applied in prefabricated sections. One common example of a polymeric foam used in the manufacture of base layer 90 is 1½ $lb/ft^3$ to 2 $lb/ft^3$ polyurethane foam which is sprayed onto form 84. In other embodiments, it is also appreciated that non-polymeric materials, such as cementitious materials, adhesives, or any other types of materials that can be applied and then set, can also be used for base layer 90.

Although not required, in one embodiment to help ensure that base layer 90 initially secures to interior surface 88 of form 84 as base layer 90 is initially applied thereto, a bonding agent is applied in a layer over interior surface 88 of form 84. In one embodiment the bonding agent comprises an acrylic latex bonding agent such as V-COAT available from Diamond Vogel Paint out of Orange City, Iowa. In other embodiments the bonding agent can simply comprise a rewettable bonding agent that has adhesive properties when hydrated so as to help stick base layer 90 to form 84. Use of the bonding agent is most applicable when base layer 90 is comprised of a cementitious material.

Although not required, the material for base layer 90 can be selected so as to have insulative properties. In this embodiment, base layer 90 forms an insulation barrier which helps control the temperature within storage compartment 48 and prevent the formation of condensation on the interior surface of outer housing 32 bounding compartment 48.

Depending on the engineering design of outer housing 32, base layer 90 can be formed as a single layer from a single application. Alternatively, base layer 90 can be comprised of multiple overlapping sub-layers of the same or different materials. For example, base layer 90 comprises a first base sub-layer 90*a* and a second base sub-layer 90*b*. First base sub-layer 90*a* and second base sub-layer 90*b* combine to form a single, substantially inseparable base layer 90.

Base layer 90 is applied to interior surface 88 of form 84 by initially spraying first base sub-layer 90*a* having a thickness in a range between about 1 cm to about 5 cm with about 1 cm to about 3 cm being more common. A plurality of spaced apart hangers 94 are then mounted on sub-layer 90*a*.

Figure 5:
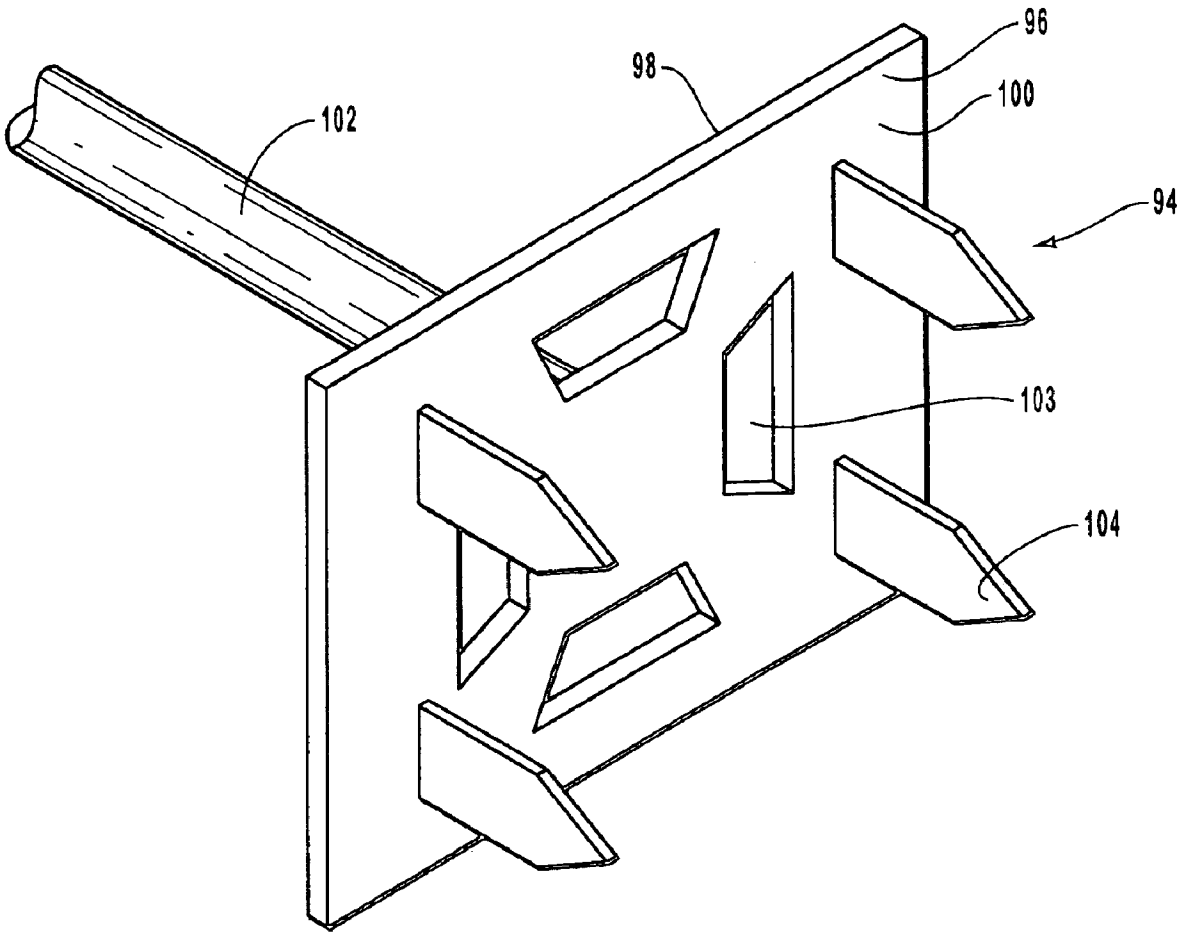
FIG. 5 is a perspective view of a hanger.

In one embodiment depicted in FIG. 5, each hanger 94 comprises a planar base plate 96 having a front side 98 and an opposing back side 100. An elongated hanger rod 102 centrally projects from front side 98. Each side of base plate 96 typically has a surface area in a range between about 1 square inch to about 4 square inches with about 2 square inches being more common. Base plate 96 is generally made of a suitable strength metallic sheet such as galvanized sheet steel. A plurality of holes 103 may be formed through base plate 96 so as to reduce the overall weight of each hanger 94 and allow communication therethrough. In an alternative embodiment, base plate 96 can be formed of other materials such as plastic, composites, or other types of metals and can have a variety of different configurations.

Outwardly projecting from back side 100 of base plate 96 are a plurality of spaced apart barbs 104. Barbs 104 are configured such that hangers 94 can initially be secured to base sub-layer 90*a* by simply pushing barbs 104 into base sub-layer 90*a* until base plate 96 rests against base sub-layer 90*a*. In alternative embodiments, barbs 104 can be formed with outwardly engaging teeth. In other embodiments, barbs 104 can have a spiral configuration or be replaced with hooks, spikes, adhesive pads, adhesive, and other conventional fasteners. Furthermore, it is appreciated that hangers 94 can be replaced with other hangers or ties used in conventional building practices.

Each hanger rod 102 is generally made of a flexible metal, such as narrow strands of cold formed steel, and is secured in a generally normal relationship to the plane of the associated base plate 96. Hangers 94 are secured to first base sub-layer 90*a* such that hanger rods 102 project inwardly from first base sub-layer 24*a* in substantially normal relation thereto.

Referring again to FIG. 4, once hangers 94 are secured to first base sub-layer 90*a*, a second base sub-layer 90*b* is sprayed over base sub-layer 90*a* so as to embed base plate 96 of hangers 94 therebetween. The now complete base layer 90 typically has a thickness in a range between about 5 cm to about 15 cm. The thickness of base layer 90 in part depends in part on the desired amount of insulation. It will be appreciated that first base sub-layer 90*a* and second base sub-layer 90*b* may have the same thickness or have different thicknesses Additionally, it will be appreciated that first base sub-layer 94*a* and second base sub-layer 94*b* may be comprised of the same material or different material. Other combinations may also be employed depending on the engineering design and construction needs of outer housing 32.

Each hanger rod 102 of hangers 94 has a predetermined length. As such, during the application of second base sub-layer 90*b*, the operator is able to visually observe the depth of base sub-layer 90*b* being applied through observing the build-up depth along the length of hanger rods 102. Additionally, the relatively thin hanger rods 102 enable a uniform spraying of polymeric foam about hanger rods 102 without impairing uniformity of density or layer thickness of the foam. Hanger rods 102 are made long enough to extend outwardly from the completed base layer 90 a distance in a range between about 8 cm to about 15 cm, although other dimensions can also be used. It is also appreciated that markings can be formed along the length of hanger rods 102 so as to assist in forming base sub-layer 90*b* to a desired depth.

As a result of base plate 96 of hangers 94 being at least partially embedded within base layer 90, a reinforcing mat, as discussed below, can now be secured to hangers 94 without pulling hangers 94 off of base layer 90. It is also appreciated that in other embodiments base plate 96 of hangers 94 can be secured directly to an interior surface 108 of base layer 90 so that base plate 96 need not be embedded within base layer 90. Alternatively, hangers 94 or alternative designs thereof can be directly secured to interior surface 88 of form 84 such as by welding, bolting, or the like.

As also depicted in FIG. 4, once base layer 90 is complete, a reinforcing mat 110 is secured adjacent to interior surface 108 of base layer 90. Reinforcing mat 110 typically comprises wire mesh or interconnected strands of conventional rebar. For example, reinforcing mat 110 can comprise horizontally spaced apart vertical strands of rebar and vertically spaced apart horizontal strands of rebar. The horizontal and vertical strands are interconnected using conventional tying methods.

Reinforcing mat 110 is secured adjacent to base layer 90 using hangers 94. That is, hanger rods 102 projecting out of base layer 90 are bent around or otherwise used to secure reinforcing mat 110 in place. Although mat 110 can be positioned directly adjacent to base layer 90, in one embodiment hangers 94 are used to support reinforcing mate 110 at a spaced apart distance from base layer 90. As a result, as will be discussed below in greater detail, reinforcing mat 110 is embedded within the support layer that is applied thereon.

It is appreciated that depending on the size, configuration, and other engineering requirements of outer housing 32, rebar of one or more different sizes can be used at different locations on outer housing 32. Furthermore, the rebar can be positioned at one or more different spaces at different locations on outer housing 32. For example, since the base of the outer housing 32 carries more weight, the rebar is typically larger and/or closer together at the base of outer housing 32 then at the top thereof. In yet other embodiments, it is appreciated that reinforcing mat 110 need not be made of conventional rebar or wire mesh but can be made from other reinforcing materials such as metal cable, wire, filaments, and the like.

If desired, simultaneously with securing reinforcing mat 110 to hangers 94 which are secured to base layer 90, additional hangers 94 can be secured directly to reinforcing mat 110. These additional hangers 94 are used for later suspension or mounting of an additional reinforcing mat 110. In addition, preconstructed frames, trusses, and other supports can be placed at previously marked door and window openings on form 22 so as to provide reinforcing around these openings. For example, as will be discussed below in greater detail, it is necessary to form openings at the top of outer housing 32 so that the bulk material can be fed into storage compartment 48. To facilitate formation of the openings, one or more frames 114 are mounted on or adjacent to interior surface 88 of form 84 so as to bound the desired openings.

Once reinforcing mat 110 has been positioned, a support layer 120 is formed so as to cover interior surface 108 of base layer 90 and reinforcing mat 110. In this regard, reinforcing mat 110 functions as reinforcing for support layer 120. Support layer 120 is applied up to frames 114 but is not applied over the intended openings.

Support layer 120 is typically comprised of a cementitious material. As used in the specification and appended claims, the term "cementitious material" is intended to include any material that includes a hydraulically settable cement. Examples of cementitious materials include Portland cement, lime cement, other pozzolanic cements, and combinations thereof. Cementitious materials typically include graded sand and/or any number of conventional additives such as fillers, fibers, hardeners, chemical additives or others with function to improve properties relating to strength, finishing, spraying, curing, and the like. In one embodiment, the cementitious material comprises sprayable, commercially available cementitious material such as "Gunite" or "Shotcrete". Support layer 120 can also be made of non-cementitious materials as long as such materials provide the required strength properties. For example, support layer 120 can also be comprised of plastics which can include different additives and fillers.

For efficiency, it is desirable that the material for support layer 120 be sprayable. For example, the cementitious material can be applied through a hose at high velocity which results in dense material having a cured compressive strength in a range between about 3,000 psi to about 10,000 psi. Alternatively, support layer 110 can be applied by hand, such as by use of a trowel, or other techniques.

Support layer 120 may be formed as a single application layer or as multiple overlapping sub-layers. For example, in one embodiment a first support sub-layer is formed over base layer 90 prior to the attachment of reinforcing mat 110. Once first support sub-layer is formed, reinforcing mat 110 is formed thereon. A second support sub-layer is then applied over the first support sub-layer so as to embed reinforcing mat 110 therebetween.

The various sub-layers of support layer 120 can be comprised of the same or different materials. Likewise, cementitious materials of different grade or properties can be used. Although not required, each successive sub-layer of support layer 120 is typically applied before the previous sub-layer is allowed to cure completely so as to effect maximum bonding between the successive sub-layers. The thickness of support layer 120 is in part dependent upon the size and configuration of outer housing 32 and whether other layers or support structures are to be added.

It will be appreciated that two or more support layers 120 may be formed so that outer housing 32 has sufficient structural strength. Depicted in FIG. 4, two support layers 120 are shown having a reinforcing mat 110 embedded in and/or between each support layer 120. As described above, additional hangers 94 can be secured in each support layer 120 or to prior reinforcing mats to secure subsequent reinforcing mats 110. It is appreciated that the type of reinforcing mat 110 may differ between different support layers 120. Furthermore, the type of reinforcing mat 110 and number of support layers 120 will vary depending on the engineering requirements of outer housing 32.

Figure 4A:
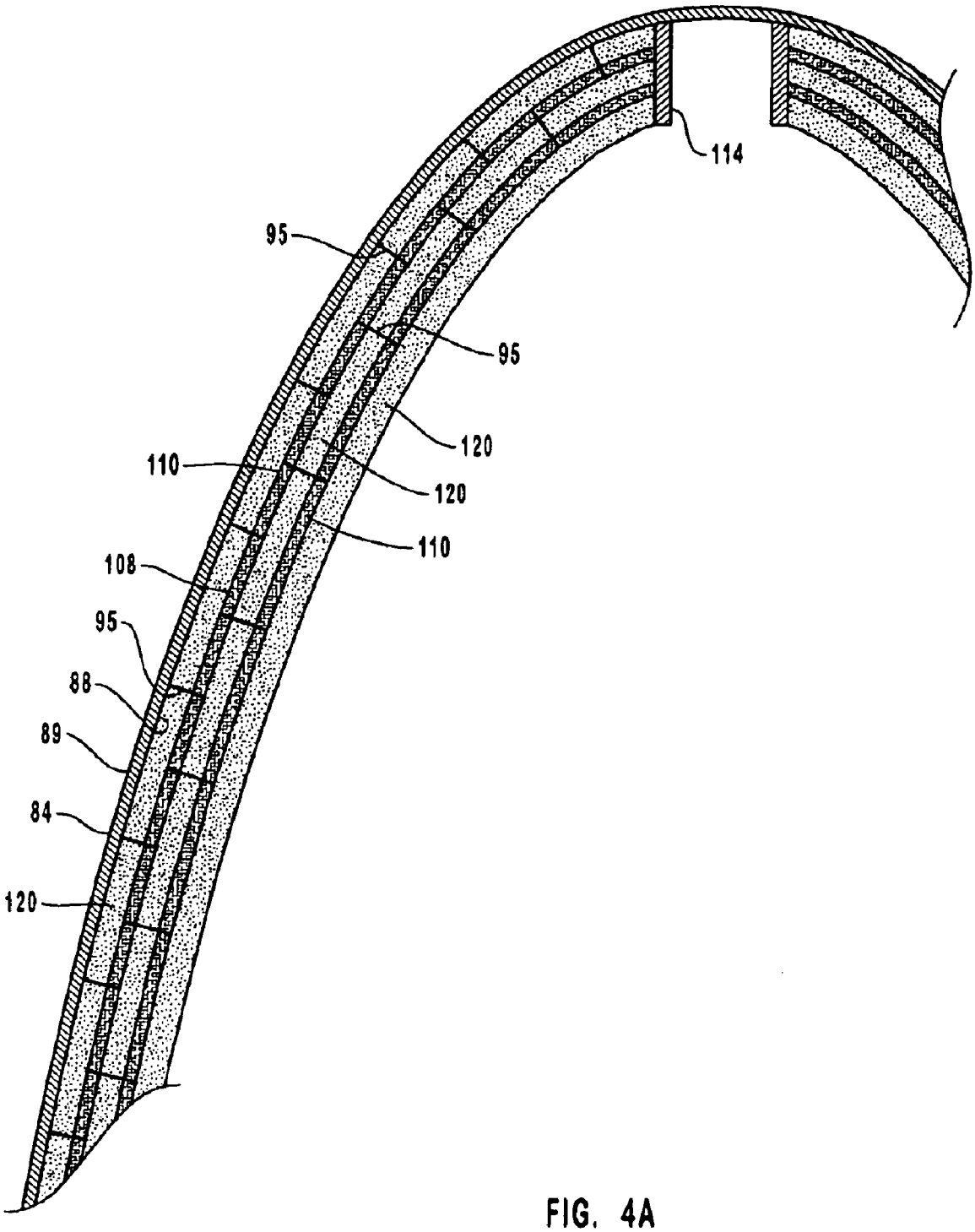
FIG. 4A is a cross sectional side view of an alternative embodiment of the side wall shown in FIG. 4.

As previously discussed, in alternative embodiments base layer 90 can be eliminated or made from other materials such as cementitious materials. For example, depicted in FIG. 4A is one embodiment having a support layer 120, comprised of a cementitious material, formed directly against interior surface 88 of form 84. Alternating layers of reinforcing mats 110 and additional support layers 120 are formed thereon. As discussed above, ties 95 hold reinforcing mats 110 in place prior to application of corresponding support layers 120. Some of ties 95 are connected to form 84 such as by being crimped between panel sections 86 of form 84. Ties 95 can comprise wire, thin metal gauge straps, or other conventional materials.

It is appreciated that outer housing 32 and thus side boundary wall 34 can be any desired length. From a practical standpoint, however, trusses 76, 78, and 80 used in the manufacture of side boundary wall 34 can only freely span a limited length. As such, for extended lengths, side boundary wall 34 is typically formed in sections of approximately 30 meters. For example, as discussed above, a first and second set of supports are separated along the intended length of outer housing 32 at a distance of about 30 meters. The trusses are then spanned therebetween and form 84 erected. Once support layers 120 are applied and allowed to cure, that section of side boundary wall 34 is self-supporting. The trusses and the first set of supports are thus removed. The first set of supports are again erected at another location 100 feet beyond the second set of supports and the trusses are extended therebetween. The process of erecting a form and applying support layers thereof is then again repeated. This process is repeated until boundary wall 34 is formed having the desired length.

After completing boundary wall 34 thus far described, the various doorways, windows, and other openings are cut. For example, the portion of form 84 bounded by frames 114 (FIG. 4) is cut out so as to form openings 116 (FIG. 6) that communicate with storage compartment 48. A protective coating such as asphalt, cementitious material, paint, sealant or combinations thereof can then be applied over exterior surface 89 of form 84.

Figure 6:
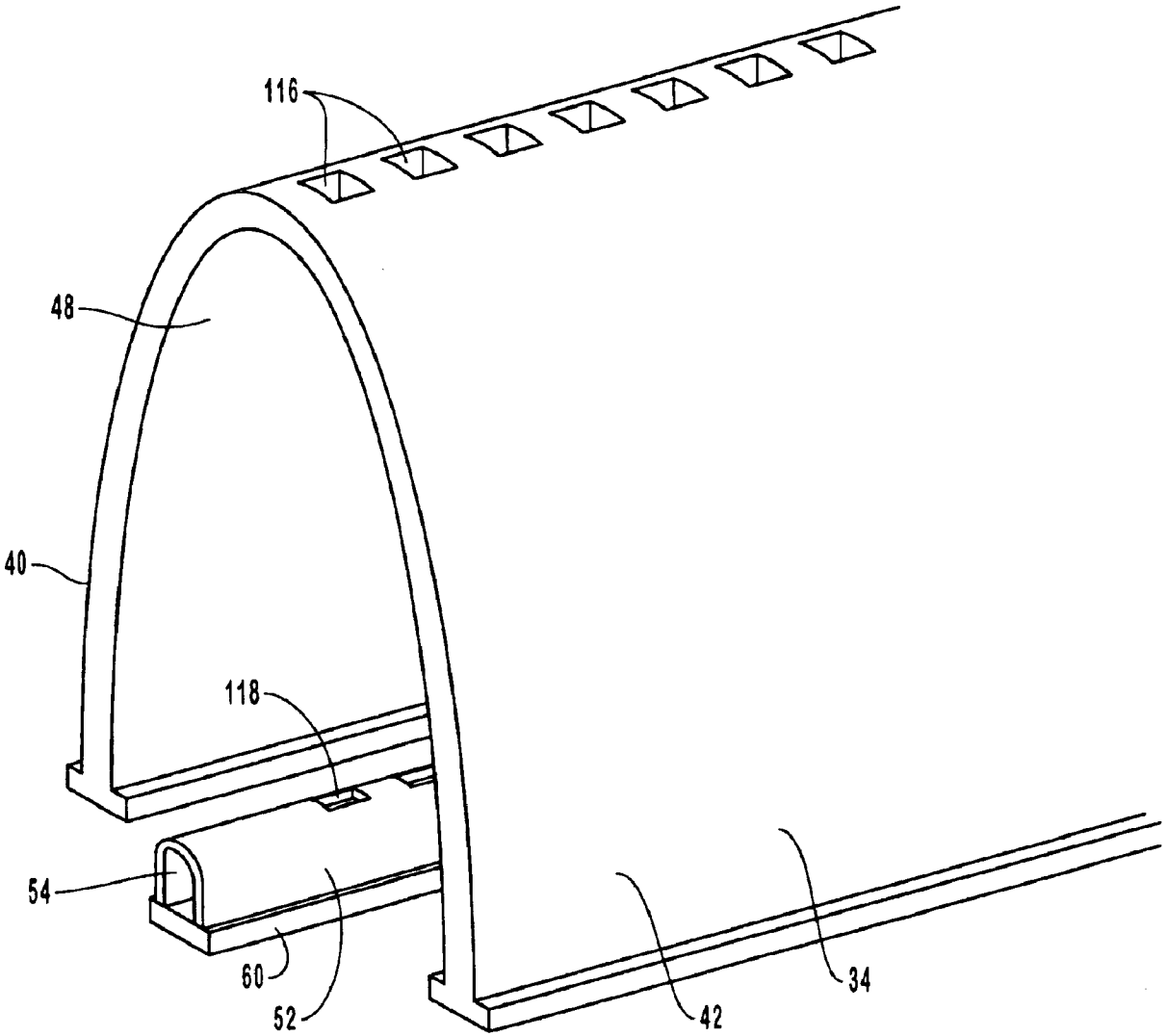
FIG. 6 is a perspective view of the side boundary wall of the housing in FIG. 2 being formed with the tunnel wall therein.

As depicted in FIG. 6, tunnel wall 52 is formed on tunnel foundation 60 prior to, during, or after formation of side boundary wall 34. In one embodiment, tunnel wall 52 is formed using substantially the same process as boundary wall 34 as discussed above. That is tunnel wall 52 can be formed by initially erecting a form and then applying one or more stabilizing layers and supports layers to obtain the desired structural integrity.

As tunnel wall 52 is much smaller than boundary wall 34, however, the process can be simplified. For example, the form can be self supporting without the use of supports or trusses. As a results, the various stabilizing and support layers can be applied on the interior and/or exterior surface of the form for tunnel wall 52. In alternative embodiments, tunnel wall 52 can be made from conventional processes such as structural steel and/or poured concrete. Tunnel wall 52 can also be prefabricated and then assembled on sight. To enable bulk material to pass from storage compartment 48 into tunnel 54, one or more openings 118 extend through the top of tunnel wall 52.

Figure 7:
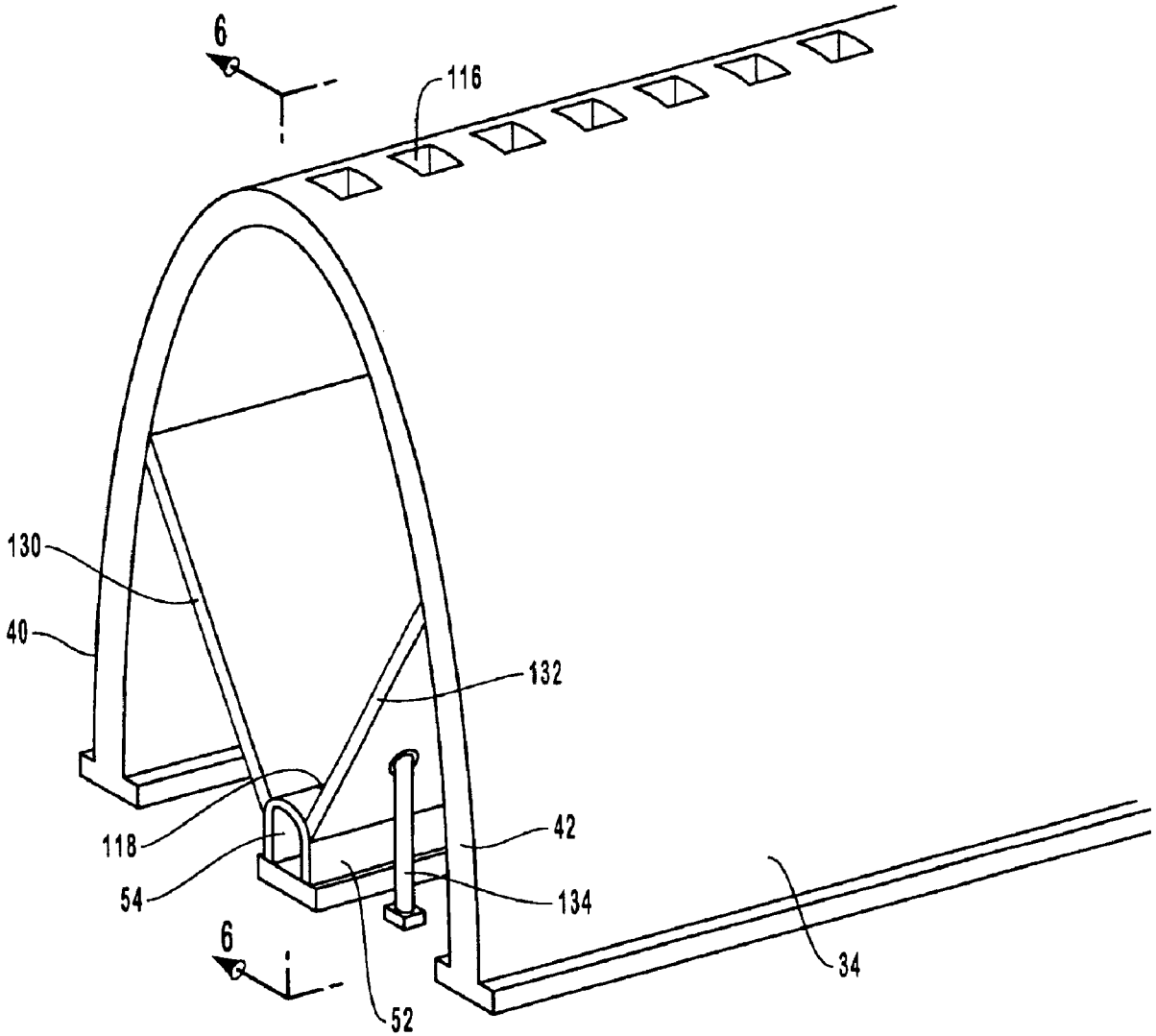
FIG. 7 is a perspective view of the system shown in FIG. 6 with sloping feeder walls extending from the side boundary wall to the tunnel wall.

Depicted in FIG. 7, once tunnel wall 52 and side boundary wall 34 are completed, a first feeder wall 130 is formed that downwardly extends at a slope and/or a curve from first sidewall 40 of side boundary wall 34 to tunnel wall 52. Similarly, a second feeder wall 132 extends at a slope and/or a curve from second sidewall 42 of side boundary wall 34 to tunnel wall 52. Feeder walls 130 and 132 are formed so as to produce a substantially V or U-shaped transverse cross section that funnels down to openings 118 on tunnel wall 52. It is also appreciated the feeder walls 130 and 132 can bow inwardly.

Figure 8:
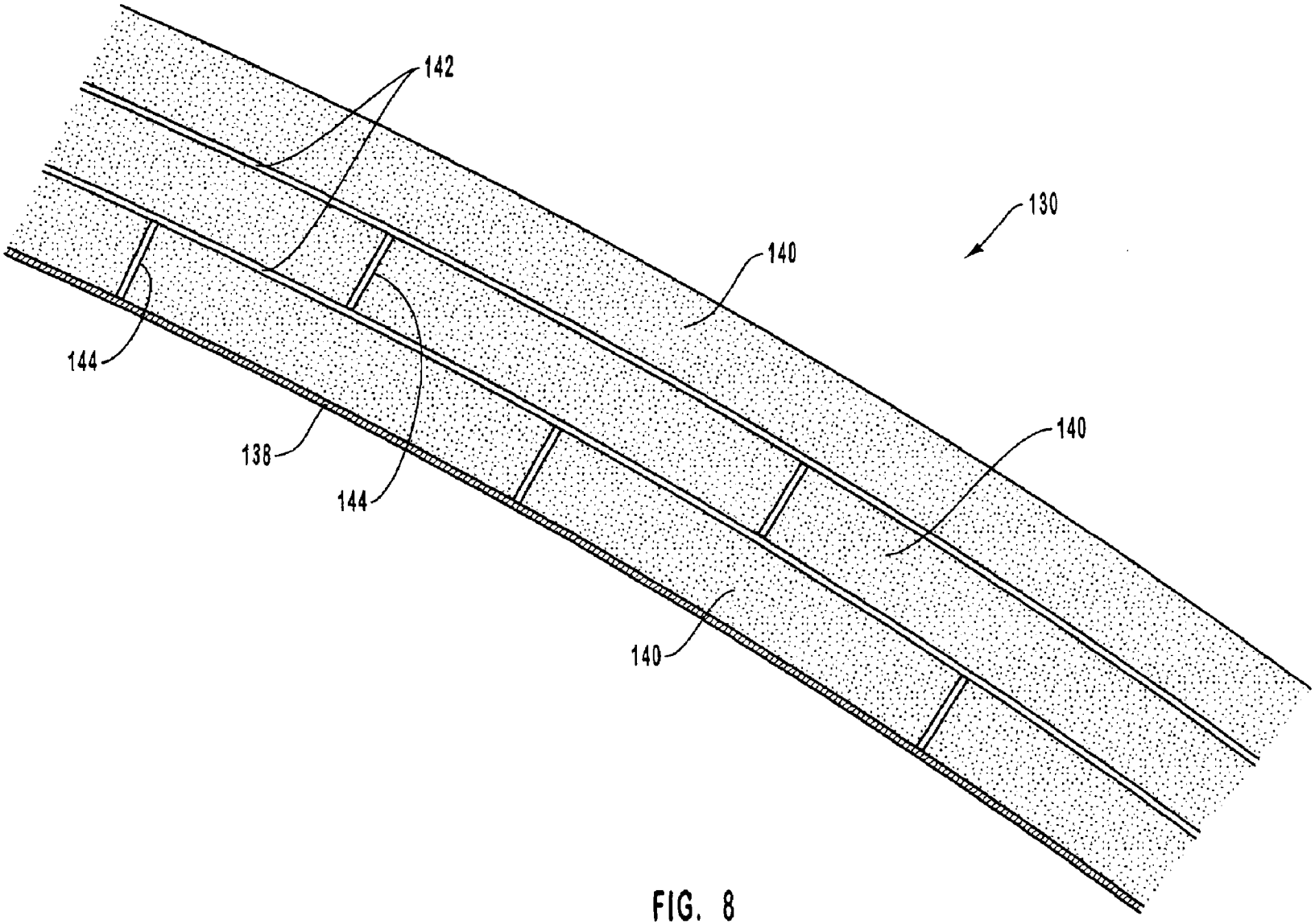
FIG. 8 is a cross sectional side view of the feeder wall shown in FIG. 7.

Feeder walls 130 and 132 can be formed using substantially the same process as discussed above with regard to the formation of side boundary wall 34. For example, as depicted in FIG. 8, a form 138 is positioned extending from first sidewall 40 of side boundary wall 34 to tunnel wall 52 along the length of side boundary wall 34. Form 138 can be formed of sheets or panels of metal that are secured together. It is envisioned that a crane can be mounted on top of tunnel wall 52 and move selectively therealong to assist in placement and securing of form 138.

Once form 138 is completed, alternating support layers 140 and reinforcing mats 142 are applied on top of form 138. Hangers 144 are used as needed for placement of reinforcing mats 142. The number and amount of support layers 140 and reinforcing mats 142 is based on design parameters. In one embodiment, a base layer of polymeric foam can first be applied on form 138. Furthermore, it is appreciated that the various base layers, support layers and reinforcing mats can be applied on the top and/or bottom surface of form 138.

In one embodiment feeder walls 130 and 132 freely span between tunnel wall 52 and side boundary wall 34. In alternative embodiments one or more braces can centrally support feeder walls 130 and/or 132. For example, a brace 134 in the form of a column is shown in FIG. 7 supporting feeder wall 132 between tunnel wall 52 and second sidewall 42 of boundary wall 34.

Figure 9:
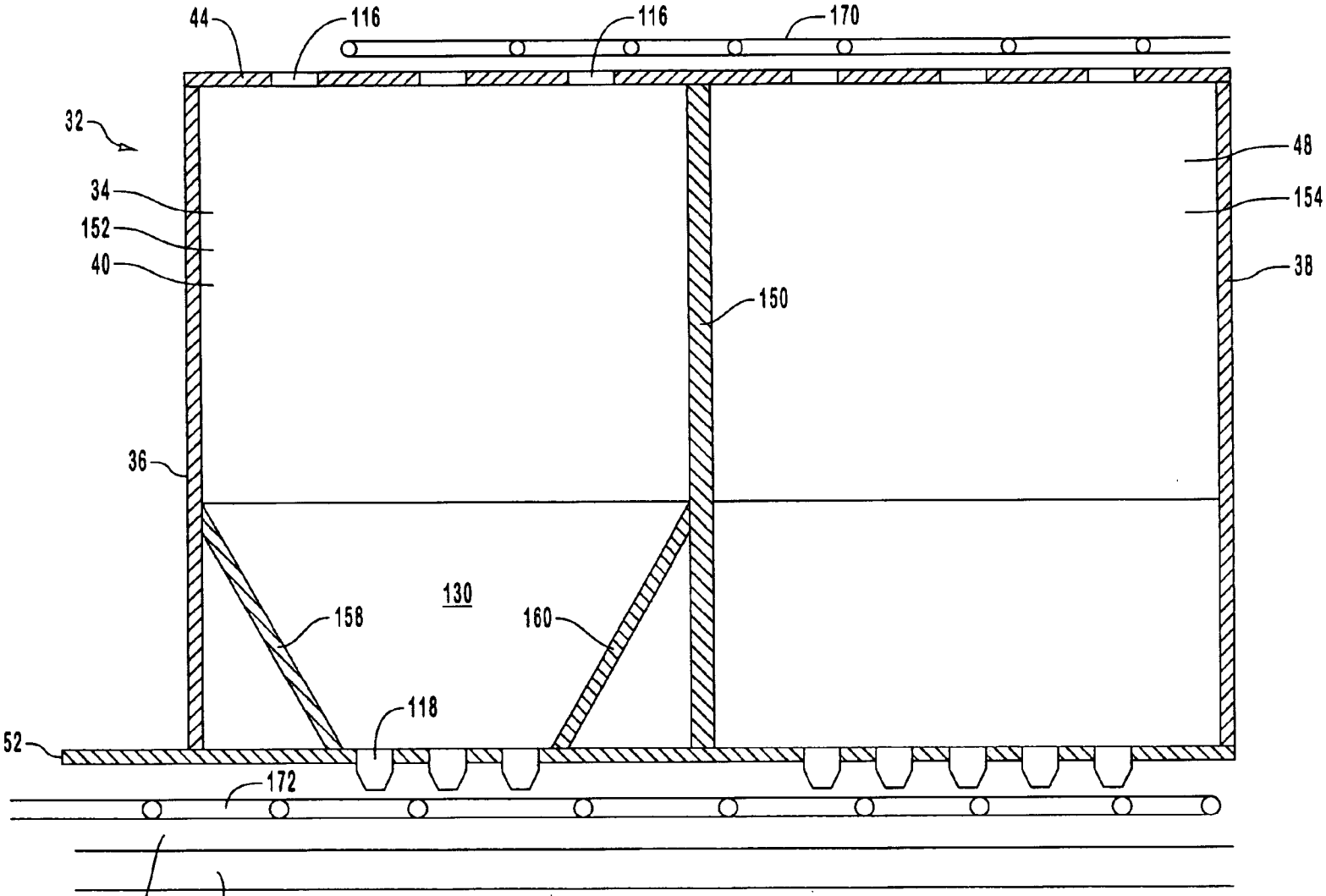
FIG. 9 is a cross sectional side view of the system shown in FIG. 2.

Depicted in FIG. 9 is a cross sectional side view of the completed outer housing 32 showing end walls 36 and 38. As shown therein, a section wall 150 is formed that partitions outer housing 32. Specifically, section wall 150 divides storage compartment 48 into a first storage chamber 152 and a second storage chamber 154 which can each store a separate isolated material. It is appreciated that outer housing 32 can be made to any desired length and that any number of section walls 150 can be made so as to enable outer housing 32 to hold a variety of different materials. Alternatively, section wall 150 can be eliminated so that only one chamber is formed.

Disposed in first storage chamber 152 is a first recovery wall 158 that downwardly slopes or curves from first end wall 36 to tunnel wall 52. Similarly, a second recovery wall 160 downwardly slopes or curves from section wall 150 to tunnel wall 52. However, as depicted in second storage chamber 154, feed walls are not required. Recovery walls 158 and 160 can have the same configuration and be made in the same manner and materials as discussed above with regard to feeder walls 130 and 132. Like feeder walls 130 and 132, recovery walls 158 and 160 direct the bulk material within first storage chamber 152 so that the bulk material naturally flows under gravitational force to openings 118 on tunnel wall 52. That is, the feeder and recovery wall minimize dead space within outer housing 32 where the bulk material does not naturally flow to openings 118 but must be mechanically moved there their.

In other embodiments feeder walls 130 and 132 and/or recovery walls 158 and 160 are not required. For example, where live recovery storage system 30 is used to store bulk material that does not spoil, such as sand, feeder walls 130 and 132 and/or recovery walls 158 and 160 can be eliminated. As storage compartment 48 is filled with the bulk material and then emptied through openings 118, the bulk material remaining in the dead spots within storage compartment 48 forms natural feeder walls and recovery walls for the remainder of the bulk material.

Mounted on top of side boundary wall 34 within conveyor housing 50 (FIG. 2) is a conveyor 170. Conveyor 170 brings the bulk material from a remote location to outer housing 32. By using one or more known switching mechanisms, conveyor 170 selectively deposits the bulk material through one or more of the openings 116 so as to fill the corresponding storage compartment with the desired bulk material. That is, a first bulk material can be deposited into first storage chamber 152 while a second bulk material can be deposited into second storage chamber 154.

Disposed within tunnel 54 is a conveyor 172. Conveyor 172 receives the bulk material passing through openings 118 of tunnel wall 52 and transports it to a secondary vehicle such as a train, barge, or truck. In alternative embodiments, tunnel 54 can be configured to have a truck, train, and/or other vehicle to pass directly therethrough. Thus the vehicle can enter tunnel 54 at one end, be loaded through openings 118, and then exit through the other end. It is also appreciated that tunnel 54 need not extend all the way through outer housing 32. For example, tunnel 54 can extend to the center of outer housing 32 with the various wall being configured to direct the bulk material for dispensing thereat. A vehicle could then back into the tunnel or a conveyor could extend therefrom. To optimize space for bulk material, tunnel 54 can also be disposed partially or completely under ground.

Figure 10:
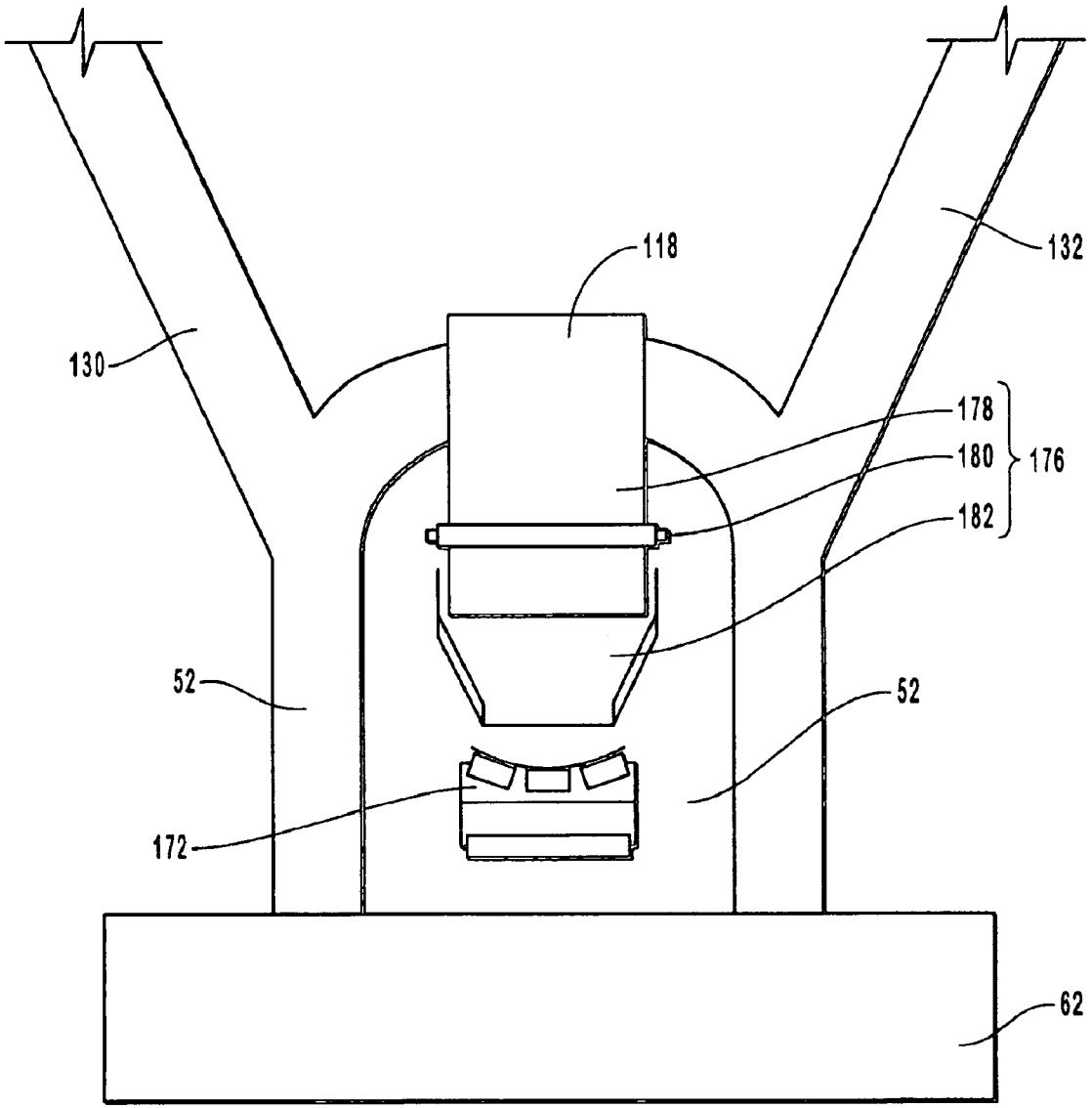
FIG. 10 is an elevated front view of a dispensing system coupled with the tunnel wall.

Finally, depicted in FIG. 10 a dispenser assembly 176 is mounted on each opening 118 of tunnel wall 52 to selectively control the flow of bulk material trough tunnel wall 52. Dispenser assembly 176 comprises a chute 178 having a pin gate 180 coupled therewith. A vibratory feeder 182 is also mounted to chute 178. Pin gate 180 and vibratory feeder 182 control the flow of bulk material through chute 178 and thus opening 118. Other conventional gates and dispensing assemblies can also be used.

Different embodiments of the present invention provide significant benefits over the prior art. For example, in the embodiment discussed above outer housing 32 is formed and operated without the required need of earthen or other external supports. Rather, housing 32 is self-supporting. Likewise, the feeder walls can also be free of the need for support by earthen banks. As a result, live recovery storage system 30 can be efficiently built occupying minimal space. Furthermore, the various designs, materials, and method of production provide a system that is cost and space efficient to build and maintain.

Figure 12:
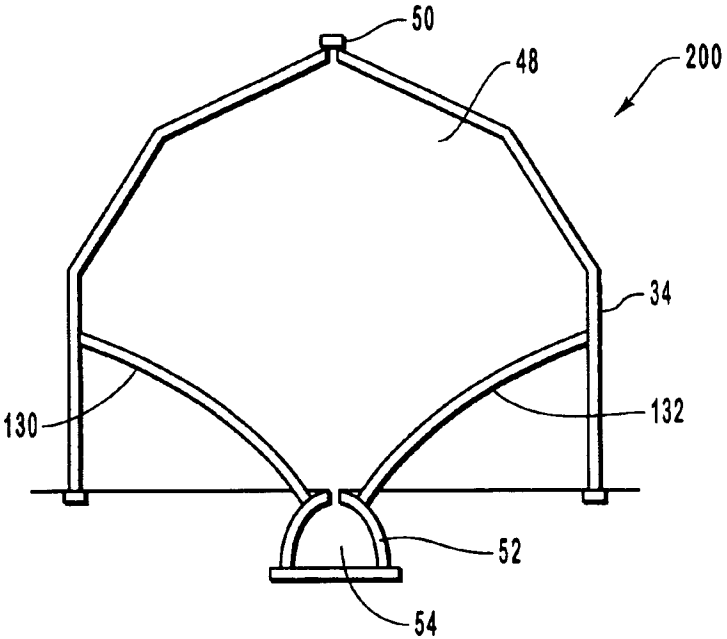
FIGS. 11 and 12 are cross sectional side views of alternative designs for live recovery storage systems.
Figure 11:
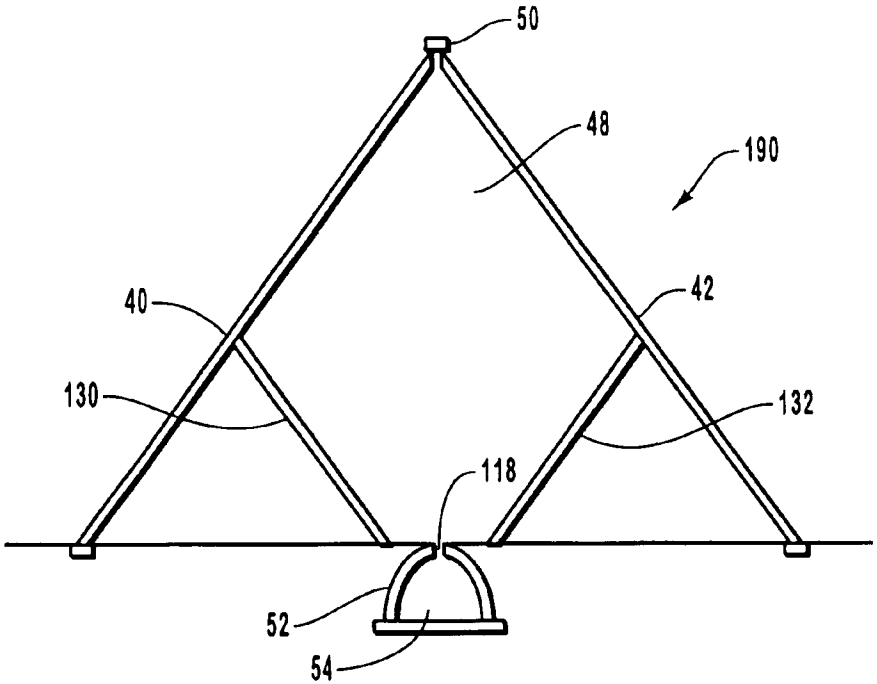

The present invention may be embodied in other specific forms without departing from its spirit or essential characteristics. For example, the various features can be mixed and matched in a variety of different configurations. Depicted in FIGS. 11 and 12 are alternative embodiments where like elements are identified by like reference characters. Depicted in FIG. 11 is a live recovery storage system 190 wherein first side wall 40 and second side wall 42 are substantially linear and intersect to form a substantially inverted V-shaped configuration. Tunnel wall 52 and corresponding tunnel 50 are underground while feeder walls 130 and 132 extend toward tunnel wall 52 but do not directly contact therewith.

Depicted in FIG. 12 is a live recovery storage system 200 wherein side boundary wall 34 is comprised of discrete linear sections that are combined to form a substantially inverted U-shaped configuration. Feeder walls 130 and 132 bow inwardly as they curve toward and connect with tunnel wall 52. It is appreciated that a variety of other alternative configurations can also be made.

In view of the foregoing, the described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A live recovery storage structure for holding bulk material comprising:

a housing comprising a first sidewall and an opposing second sidewall each extending between a first end wall and an opposing second end wall, wherein the housing is comprised of multiple discrete layers of cementitious material;

an elongated tunnel wall extending within or below the housing, the tunnel wall bounding a tunnel;

a first feeder wall downwardly extending at a slope or a curve from the first sidewall of the housing toward the tunnel wall;

a second feeder wall downwardly extending at a slope or a curve from the second sidewall of the housing toward the tunnel wall, at least one of the first feeder wall and the second feeder wall being at least partially freely suspended within the housing;

the first feeder wall, the second feeder wall, and the housing at least partially bounding a storage compartment;

at least one opening being formed on the housing so as to provide fluid communication with the storage compartment; and a dispenser mounted on the tunnel wall so as to provide controlled fluid communication between the storage compartment and the tunnel.

2. A live recovery storage structure as recited in claim 1, wherein the first feeder wall extends between the first sidewall and the tunnel wall.

3. A live recovery storage structure as recited in claim 2, wherein the first feeder wall freely spans between the first sidewall and the tunnel wall.

4. A live recovery storage structure as recited in claim 1, wherein a brace supports the first feeder wall at a location between the first sidewall and the tunnel wall.

5. A live recovery storage structure as recited in claim 1, wherein the housing comprises a side boundary wall which includes the first sidewall and the second sidewall, the side boundary wall having an inverted substantially U-shaped transverse cross section.

6. A live recovery storage structure as recited in claim 1, wherein the housing comprises a side boundary wall which includes the first sidewall and the second sidewall, the side boundary wall having a substantially parabolic transverse cross section.

7. A live recovery storage structure as recited in claim 1, wherein the housing is self-supporting independent of the tunnel wall.

8. A live recovery storage structure as recited in claim 1, wherein at least one of the first end wall and the second end wall is vertically disposed.

9. A live recovery storage structure as recited in claim 1, wherein a conveyor is disposed on the housing, the conveyor being adapted to transfer bulk material to the at least one opening formed on the housing.

10. A live recovery storage structure as recited in claim 1, wherein a conveyor is disposed in the tunnel, the conveyor being adapted to receive bulk material passing through the dispenser.

11. A live recovery storage structure as recited in claim 1, further comprising a recovery wall that downwardly slopes or curves from the first end wall to the tunnel wall.

12. A live recovery storage structure as recited in claim 1, further comprising a vertically disposed section wall disposed in the storage compartment.

13. A live recovery storage structure as recited in claim 1, wherein the elongated tunnel wall extends in alignment between the first end wall and the second end wall of the housing.

14. A live recovery storage structure for holding bulk material comprising:

a housing comprising a side boundary wall having an inverted substantially U-shaped or V-shaped transverse cross section that extends between a first end wall and an opposing second end wall, the housing bounding a chamber adapted to receive bulk such that the bulk material rests against the side boundary wall;

an elongated tunnel wall extending within or below the housing, the tunnel wall bounding a tunnel;

a first feeder wall downwardly extending at a slope or a curve from the side boundary wall toward the tunnel wall, wherein the first feeder wall freely suspends between the side boundary wall and the tunnel wall;

at least one opening being formed on the housing so as to provide fluid communication with the chamber; and a dispenser assembly mounted on the tunnel wall so as to proved controlled fluid communication between the chamber and the tunnel.

15. A live recovery storage structure as recited in claim 14, wherein the housing is self-supporting independent of the tunnel wall.

16. A live recovery storage structure as recited in claim 14, wherein at least one of the first end wall and the second end wall is vertically oriented.

17. A live recovery storage structure as recited in claim 14, wherein the side boundary wall comprises:

a form having an interior surface; and a plurality of layers of cementitious material disposed on the interior surface of the form.

18. A live recovery storage structure as recited in claim 14, wherein a conveyor is disposed on the housing, the conveyor being adapted to transfer bulk material to the at least one opening formed on the housing.

19. A live recovery storage structure as recited in claim 14, wherein a conveyor is disposed in the tunnel, the conveyor being adapted to receive bulk material passing through the hopper assembly.

20. A live recovery storage structure as recited in claim 14, further comprising a second feeder wall downwardly extending at a slope or a curve from the side boundary wall toward the tunnel wall, the second feeder wall being spaced apart from the fist feeder wall.

21. A live recovery storage structure as recited in claim 14, wherein the dispenser assembly comprises a chute having a gate formed therein.

22. A live recovery storage structure for holding bulk material comprising:

a housing comprising a first sidewall and an opposing second sidewall each extending between a first end wall and an opposing second end wall;

an elongated tunnel wall extending within or below the housing, the tunnel wall bounding a tunnel;

a first feeder wall downwardly extending at a slope or a curve from the first sidewall of the housing to the tunnel wall, wherein the first feeder wall extends and freely spans between the first sidewall and the tunnel wall;

a second feeder wall downwardly extending at a slope or a curve from the second sidewall of the housing toward the tunnel wall;

the first feeder wall, the second feeder wall, and the housing at least partially bounding a storage compartment;

at least one opening being formed on the housing so as to provide fluid communication with the storage compartment; and a dispenser providing controlled fluid communication between the storage compartment and the tunnel.

23. A live recovery storage structure as recited in claim 22, wherein the housing comprises a side boundary wall which includes the first sidewall and the second sidewall, the side boundary wall having a substantially parabolic transverse cross section.

24. A live recovery storage structure as recited in claim 22, wherein the housing is self-supporting independent of the tunnel wall.

25. A live recovery storage structure for holding bulk material comprising:

a housing comprising a side boundary wall extending between a first end wall and an opposing second end wall, the side boundary wall having a substantially parabolic transverse cross section, the housing at least partially bounding a chamber;

an elongated tunnel wall extending within or below the housing, the tunnel wall bounding a tunnel; and a dispenser providing controlled fluid communication between the chamber of the housing and the tunnel.

26. A live recovery storage structure as recited in claim 25, wherein the side boundary wall has an inverted substantially U-shaped transverse cross section.

27. A live recovery storage structure as recited in claim 25, wherein the housing is self-supporting independent of the tunnel wall.

28. A live recovery storage structure as recited in claim 25, wherein at least a portion of the tunnel wall upwardly projects into and is freely exposed within the chamber of the housing.

29. A live recovery storage structure as recited in claim 25, wherein the tunnel wall has a inverted substantially U-shaped transverse cross section.

30. A live recovery storage structure as recited in claim 25, further comprising a first feeder wall downwardly extending from the side boundary wall of the housing to the tunnel wall.

31. A live recovery structure as recited in claim 30, further comprising a second feeder wall downwardly extending from the side boundary wall of the housing to the tunnel wall, the second feeder wall opposing the first feeder wall.

32. A live recovery storage structure as recited in claim 25, further comprising a recovery wall that downwardly slopes or curves from the first end wall to the tunnel wall.

33. A live recovery storage structure for holding bulk material comprising:

a housing comprising a first sidewall and an opposing second sidewall each extending between a first end wall and an opposing second end wall, the housing at least partially bounding a chamber;

an elongated tunnel wall extending within or below the housing, the tunnel wall bounding a tunnel;

a first feeder wall downwardly extending from the first sidewall of the housing toward the tunnel wall;

a second feeder wall downwardly extending from the second sidewall of the housing toward the tunnel wall;

a recovery wall that downwardly slopes or curves from the first end wall to the tunnel wall;

at least one opening being formed on the housing so as to provide fluid communication to the chamber; and a dispenser providing controlled fluid communication between the chamber of the housing and the tunnel.

34. A live recovery storage structure as recited in claim 33, wherein the housing comprises a side boundary wall which includes the first sidewall and the second sidewall, the side boundary wall having a substantially parabolic transverse cross section.

35. A live recovery storage structure as recited in claim 33, wherein the housing is self-supporting independent of the tunnel wall.

36. A live recovery storage structure as recited in claim 33, wherein at least a portion of the tunnel wall upwardly projects into and is freely exposed within the chamber of the housing.

37. A live recovery storage structure as recited in claim 33, wherein the tunnel wall has a inverted substantially U-shaped transverse cross section.

38. A live recovery storage structure as recited in claim 33, wherein the first feeder wall extends between the first sidewall and the tunnel wall.

39. A live recovery storage structure as recited in claim 38, wherein at least a portion of the first feeder wall is freely suspended.

40. A live recovery storage structure for holding bulk material comprising:

a housing comprising a side boundary wall having an inverted substantially U-shaped or V-shaped transverse cross section that extends between a first end wall and an opposing second end wall, the housing bounding a chamber adapted to receive bulk such that the bulk material rests against the side boundary wall, the side boundary wall comprising a form having an interior surface, and a plurality of layers of cementitious material disposed on the interior surface of the form;

an elongated tunnel wall extending within or below the housing, the tunnel wall bounding a tunnel;

at least one opening being formed on the housing so as to provide fluid communication with the chamber; and a dispenser assembly mounted on the tunnel wall so as to proved controlled fluid communication between the chamber and the tunnel.

41. A live recovery storage structure as recited in claim 40, further comprising a first feeder wall downwardly extending at a slope or a curve from the side boundary wall toward the tunnel wall.

42. A live recovery storage structure as recited in claim 40, wherein the side boundary wall has a substantially parabolic transverse cross section.

* * * * *

UNITED STATES PATENT AND TRADEMARK OFFICE

CERTIFICATE OF CORRECTION

PATENT NO. : 6,931,801 B2
DATED : August 23, 2005
INVENTOR(S) : Thomas W. Hedrick It is certified that error appears in the above-identified patent and that said Letters Patent is hereby corrected as shown below:

Column 1,
Line 56, after "limiting of" insert -- its scope. --.

Column 2,
Line 56, change "used a foundation" to -- used as a foundation --.

Column 3,
Line 13, change "placement" to -- placements --.

Column 4,
Line 66, change "24a" to -- 90a --.

Column 5,
Line 6, after "layer 90" remove "in part".
Line 10, change "thickness Additionally" to -- thickness. Additionally --.
Line 11, change "94a" to -- 90a --; and change "94b" to -- 90b --.
Line 56, change "mate" to -- mat --.

Column 6,
Line 1, change "then" to -- than --.
Line 7, change "hangers 94 which are" to -- hangers 94, which are --.
Line 13, change "22" to -- 84 --.

Column 7,
Line 63, change "supports" to -- support --.

Column 8,
Line 1, change "results" to -- result --.
Line 6, change "sight" to -- site --.

Column 9,
Line 8, remove "their".
Line 40, change "wall" to -- walls --.
Line 44, change "under ground" to -- underground --.

UNITED STATES PATENT AND TRADEMARK OFFICE

CERTIFICATE OF CORRECTION

PATENT NO. : 6,931,801 B2
DATED : August 23, 2005
INVENTOR(S) : Thomas W. Hedrick It is certified that error appears in the above-identified patent and that said Letters Patent is hereby corrected as shown below:

Column 11,
Line 45, change "proved" to -- provide --.

Column 14,
Line 26, change "proved" to -- provide --.

Signed and Sealed this

Eighteenth Day of April, 2006

JON W. DUDAS
*Director of the United States Patent and Trademark Office*